US011125461B2

(12) United States Patent
O'Hora

(10) Patent No.: US 11,125,461 B2
(45) Date of Patent: Sep. 21, 2021

(54) SMART VENT SYSTEM WITH LOCAL AND CENTRAL CONTROL

(71) Applicant: Gerard O'Hora, Brighton, MA (US)

(72) Inventor: Gerard O'Hora, Brighton, MA (US)

(73) Assignee: Gerard O'Hora, Brighton, MA (US)

( * ) Notice: Subject to any disclaimer, the term of this patent is extended or adjusted under 35 U.S.C. 154(b) by 244 days.

(21) Appl. No.: 16/007,642

(22) Filed: Jun. 13, 2018

(65) Prior Publication Data

US 2018/0356114 A1 Dec. 13, 2018

Related U.S. Application Data

(60) Provisional application No. 62/519,027, filed on Jun. 13, 2017.

(51) Int. Cl.

| | |
|---|---|
| ***F24F 11/54*** | (2018.01) |
| ***F24F 11/79*** | (2018.01) |
| ***F24F 11/00*** | (2018.01) |
| ***F24F 11/58*** | (2018.01) |
| ***F24F 11/72*** | (2018.01) |
| *F24F 110/10* | (2018.01) |

(52) U.S. Cl.

CPC ..... *F24F 11/54* (2018.01); *F24F 11/0001* (2013.01); *F24F 11/58* (2018.01); *F24F 11/72* (2018.01); *F24F 11/79* (2018.01); *F24F 2110/10* (2018.01)

(58) Field of Classification Search

CPC .... F24F 2110/10; F24F 11/0001; F24F 11/54; F24F 11/58; F24F 11/72; F24F 11/79

See application file for complete search history.

(56) References Cited

U.S. PATENT DOCUMENTS 2,938,686 A 5/1960 Winkle et al.
4,407,445 A * 10/1983 Vivian ..... F24D 5/00 165/47

(Continued)

FOREIGN PATENT DOCUMENTS

CN 108352537 A 7/2018
EP 2 861 473 A1 4/2015

(Continued)

OTHER PUBLICATIONS

International Search Report and Written Opinion for PCT/US16/45048 dated Dec. 15, 2016, all pages.

(Continued)

*Primary Examiner* — Steven S Anderson, II

(74) *Attorney, Agent, or Firm* — Kilpatrick Townsend & Stockton, LLP

(57) ABSTRACT

An energy system incorporated within an environment includes a local control for receiving a local temperature input corresponding to an enclosure within the environment; an airway manipulation device situated within or within a threshold distance of the enclosure, where the airway manipulation device is configured to modify at least one aperture separating two volumes. The energy system also includes a central control for receiving a central temperature input for an area that includes the enclosure, and one or more processors programmed to control the airway manipulation device based at least in part on the local temperature input and a central temperature input.

20 Claims, 8 Drawing Sheets

(56) References Cited

U.S. PATENT DOCUMENTS 5,756,227 A 5/1998 Suzuki et al.
5,803,357 A * 9/1998 Lakin ..... G01K 1/026 236/78 B
6,122,603 A 9/2000 Budike, Jr.
7,059,769 B1 6/2006 Potega
7,949,435 B2 5/2011 Pollack et al.
8,045,970 B2 10/2011 Yang et al.
8,359,112 B2 1/2013 Kephart et al.
8,406,477 B2 3/2013 Chen et al.
8,473,111 B1 6/2013 Shankar et al.
8,816,870 B2 8/2014 Plaisted et al.
8,830,676 B2 9/2014 Borck et al.
8,865,337 B2 10/2014 Culver et al.
8,907,811 B2 12/2014 Windstrup et al.
9,187,004 B1 11/2015 Davis
9,300,141 B2 3/2016 Marhoefer
9,361,141 B2 6/2016 Warfield et al.
9,434,270 B1 9/2016 Penilla et al.
9,438,573 B2 9/2016 Cregg
9,467,939 B2 10/2016 Hahn
9,680,188 B2 6/2017 O'Hora
9,711,989 B2 7/2017 Shin et al.
9,716,718 B2 7/2017 Belton et al.
9,817,376 B1 11/2017 Wartena et al.
9,819,060 B2 11/2017 O'Hora
9,912,015 B2 3/2018 O'Hora
9,960,637 B2 5/2018 Sanders
9,980,779 B2 5/2018 Hurley et al.
10,147,984 B2 12/2018 O'Hora
10,203,738 B2 2/2019 O'Hora
2002/0136042 A1 9/2002 Layden et al.
2003/0099883 A1 5/2003 Ochoa et al.
2005/0007042 A1 1/2005 Moore et al.
2006/0276938 A1 12/2006 Miller
2007/0127346 A1 6/2007 Goodman et al.
2007/0162245 A1 7/2007 Costea et al.
2007/0181547 A1 8/2007 Vogel et al.
2007/0267999 A1 11/2007 Buckley et al.
2008/0072289 A1 3/2008 Aoki et al.
2008/0197199 A1 8/2008 Terlizzi et al.
2009/0072991 A1 3/2009 Hayashi et al.
2009/0096416 A1 4/2009 Tonegawa et al.
2009/0251925 A1 10/2009 Usui et al.
2009/0264063 A1* 10/2009 Tinsley ..... F24F 13/1426 454/324
2009/0314382 A1 12/2009 Capizzo
2010/0007515 A1 1/2010 Ito
2010/0017045 A1 1/2010 Nesler et al.
2010/0030083 A1 2/2010 Sanders et al.
2010/0104927 A1 4/2010 Albright
2010/0104935 A1 4/2010 Hermann et al.
2010/0245103 A1 9/2010 Plaisted et al.
2010/0315197 A1 12/2010 Solomon et al.
2011/0014501 A1 1/2011 Scheucher
2011/0106279 A1 5/2011 Cho et al.
2011/0106294 A1 5/2011 Bebbington
2011/0149720 A1 6/2011 Phuah et al.
2011/0204720 A1 8/2011 Ruiz et al.
2011/0234165 A1 9/2011 Palatov
2011/0261057 A1 10/2011 Freyhult et al.
2011/0302078 A1 12/2011 Failing
2012/0039503 A1 2/2012 Chen et al.
2012/0169511 A1 7/2012 Windstrup et al.
2012/0316671 A1 12/2012 Hammerslag et al.
2013/0026972 A1 1/2013 Luke et al.
2013/0059182 A1 3/2013 Komatsu et al.
2013/0064250 A1 3/2013 Kim et al.
2013/0164567 A1 6/2013 Olsson et al.
2013/0166081 A1 6/2013 Sanders et al.
2013/0205372 A1 8/2013 Gilbert et al.
2013/0214763 A1 8/2013 Kubota et al.
2013/0288083 A1 10/2013 Sweetland et al.
2013/0297084 A1 11/2013 Kubota et al.
2013/0315197 A1 11/2013 Park et al.
2014/0015469 A1 1/2014 Beaston et al.
2014/0081465 A1 3/2014 Wang et al.
2014/0097797 A1 4/2014 Hendrix et al.
2014/0136007 A1 5/2014 Williams
2014/0303835 A1* 10/2014 VerWoert ..... B60H 1/00842 701/36
2014/0336837 A1 11/2014 Kiuchi et al.
2014/0377623 A1 12/2014 Pyzza et al.
2015/0037649 A1 2/2015 Wyatt et al.
2015/0042285 A1 2/2015 Doerndorfer
2015/0048684 A1 2/2015 Rooyakkers et al.
2015/0056475 A1 2/2015 Adrian et al.
2015/0073608 A1 3/2015 Ippolito et al.
2015/0236936 A1 8/2015 Waldbusser
2015/0261198 A1 9/2015 Rice
2015/0333512 A1 11/2015 Saussele et al.
2015/0350818 A1 12/2015 Hammett et al.
2016/0003918 A1 1/2016 Wada et al.
2016/0033946 A1 2/2016 Zhu et al.
2016/0065383 A1 3/2016 Lu
2016/0093843 A1 3/2016 Reineccius et al.
2016/0093848 A1 3/2016 DeKeuster et al.
2016/0094056 A1 3/2016 Dulle
2016/0105513 A1 4/2016 Bauman et al.
2016/0129801 A1 5/2016 Gale et al.
2016/0149758 A1 5/2016 Kinoshita et al.
2016/0265224 A1* 9/2016 Byers ..... E04B 9/06
2016/0277216 A1 9/2016 Carson et al.
2016/0329710 A1 11/2016 Clifton
2016/0330200 A1 11/2016 Ansari et al.
2017/0033337 A1 2/2017 O'Hora
2017/0033338 A1 2/2017 O'Hora
2017/0033408 A1 2/2017 O'Hora
2017/0034257 A1 2/2017 Parikh et al.
2017/0045868 A1* 2/2017 Cavarec ..... F24F 11/30
2017/0085438 A1 3/2017 Link et al.
2017/0242411 A1 8/2017 Papadopoulos
2017/0279170 A1 9/2017 O'Hora
2018/0152322 A1 5/2018 Sridhar et al.
2018/0176819 A1 6/2018 Papa et al.
2018/0181434 A1 6/2018 Ivanov et al.
2018/0183903 A1 6/2018 Mishra et al.
2018/0191742 A1 7/2018 Dawes
2018/0248968 A1 8/2018 Wang et al.
2018/0288136 A1 10/2018 Maskalik et al.
2018/0302326 A1 10/2018 Thakkar et al.
2018/0309818 A1 10/2018 Park et al.
2018/0356867 A1 12/2018 O'Hora
2018/0359109 A1 12/2018 O'Hora
2019/0028573 A1 1/2019 Cook et al.
2019/0044703 A1 2/2019 Smith
2019/0058628 A1 2/2019 Boucadair et al.
2019/0103641 A1 4/2019 O'Hora
2019/0118782 A1 4/2019 O'Hora
2019/0132145 A1 5/2019 O'Hora
2019/0149402 A1 5/2019 Ramachandran et al.
2019/0149433 A1 5/2019 Ramachandran et al.
2019/0149514 A1 5/2019 Jawahar

FOREIGN PATENT DOCUMENTS

EP 2 876 702 A1 5/2015
KR 101146492 B1 5/2012
WO 2014/207658 A1 12/2014
WO 2017/023869 A1 2/2017
WO 2018/231932 12/2018
WO 2019/079817 A1 4/2019

OTHER PUBLICATIONS

International Preliminary Report on Patentability for PCT/US16/45048 dated Feb. 6, 2018, all pages.
International Search Report and Written Opinion for PCT/US18/37258 dated Jul. 3, 2018, 11 pages.
International Search Report and Written Opinion for PCT/US18/056941 dated Jan. 2, 2019, all pages.
MBEAM, "The Modular Battery Exchange System: A Common Sense Approach to Full Adoption of Clean Electric Transportation,"

(56) References Cited

OTHER PUBLICATIONS 10 pages. Retrieved from http://www.modularexchange.com/?page_id=141 Accessed on Jul. 1, 2016.
MBEAM, "First Updated Module," 18 pages. Retrieved from http://www.modularexchange.com/?p=314 Access on Jul. 1, 2016.
International Preliminary Report on Patentability for PCT/US2018/037258 dated Aug. 1, 2019, all pages.
U.S. Appl. No. 15/811,659, filed Nov. 13, 2017, Final Rejection dated Aug. 27, 2019, all pages.
European Search Report for EP16833691 dated Dec. 14, 2018, all pages.
U.S. Appl. No. 15/225,620, filed Aug. 1, 2016, Non-Final Rejection dated Nov. 9, 2016, all pages.
U.S. Appl. No. 15/225,620, filed Aug. 1, 2016, Notice of Allowance dated Apr. 11, 2017, all pages.
U.S. Appl. No. 15/225,680, filed Aug. 1, 2016, Pre-Interview first office action dated Nov. 30, 2016, all pages.
U.S. Appl. No. 15/225,680, filed Aug. 1, 2016, First Action Interview dated Mar. 27, 2017, all pages.
U.S. Appl. No. 15/225,680, filed Aug. 1, 2016, Notice of Allowance dated Aug. 25, 2017, all pages.
U.S. Appl. No. 15/225,656, filed Aug. 1, 2016, Non-Final Rejection dated Nov. 30, 2016, all pages.
U.S. Appl. No. 15/225,656, filed Aug. 1, 2016, Notice of Allowance dated Jul. 5, 2017, all pages.
U.S. Appl. No. 15/621,364, filed Jun. 13, 2017, Non-Final Rejection dated Dec. 15, 2017, all pages.
U.S. Appl. No. 15/621,364, filed Jun. 13, 2017, Notice of Allowance dated Oct. 18, 2018, all pages.
U.S. Appl. No. 15/621,268, filed Jun. 13, 2017, Non-Final Rejection dated Jan. 24, 2018, all pages.
U.S. Appl. No. 15/621,268, filed Jun. 13, 2017, Notice of Allowance dated Sep. 24, 2018, all pages.
U.S. Appl. No. 15/811,659, filed Nov. 13, 2017, Non-Final Rejection dated Feb. 25, 2019, all pages.

* cited by examiner

SMART VENT SYSTEM WITH LOCAL AND CENTRAL CONTROL

CROSS-REFERENCES TO RELATED APPLICATIONS

The present application is a nonprovisional of and claims the benefit of U.S. Provisional Application No. 62/519,027, filed Jun. 13, 2017, the entire contents of which are hereby incorporated herein by reference. This application is also related to U.S. patent application Ser. No. 15/811,659 filed on Nov. 13, 2017, which is also incorporated herein by reference.

BACKGROUND OF THE INVENTION

Heating, ventilation, and air conditioning (HVAC) systems generally operate by distributing conditioned (e.g., heated/cooled) air taken from return ducts and pushed through delivery ducts to an environment such as a home or office building. A thermostat typically controls the length of time that the HVAC system will provide conditioned air to the environment to maintain a setpoint temperature that is centrally controlled.

BRIEF SUMMARY OF THE INVENTION

In some embodiments, an energy system incorporated within an environment may include a local control for receiving a local temperature input corresponding to an enclosure within the environment. The energy system may also include an airway manipulation device situated within or within a threshold distance of the enclosure. The airway manipulation device may be configured to modify at least one aperture separating two volumes. The energy system may also include a central control for receiving a central temperature input for an area that includes the enclosure. The energy system may further include one or more processors programmed to control the airway manipulation device based at least in part on the local temperature input and a central temperature input.

In some embodiments, a method for controlling an energy system incorporated within an environment may include receiving, from a local control, a local temperature input corresponding to an enclosure within the environment. The method may also include receiving, from a central control, a central temperature input for an area that includes the enclosure. The method may further include controlling an airway manipulation device based at least in part on the local temperature input and a central temperature input. The airway manipulation device may be situated within or within a threshold distance of the enclosure. The airway manipulation device may be configured to modify at least one aperture separating two volumes.

In any embodiments, one or more the following features may be implemented in any combination and without limitation. The airway manipulation device may communicate with the one or more processors using an ethernet connection. The airway manipulation device may receive power to modify the at least one aperture through the ethernet connection. The energy system may also include a plurality of local controls that includes the local control, where the local controls are located in enclosures that are within a threshold distance of the enclosure. The processor operations and/or method may further include sending a coordinated control to a plurality of airway manipulation devices corresponding to the plurality of local controls, where the coordinated control compensates for sunlight exposure. The processor operations and/or method may further include receiving a plurality of local temperature inputs from the local controls and adjust the central temperature input for the area based on the plurality of local temperature inputs. The processor operations and/or method may further include operating an energy virtualization layer that receives commands from a plurality of energy control devices and controls the flow of energy between a plurality of energy producing devices and a plurality of energy consuming devices. Controlling the airway manipulation device may include moving a plurality of panels to modify the at least one aperture. The local temperature input may be averaged with the central temperature input. The local temperature input may override the central temperature input.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and various ways in which it may be practiced.

In the appended figures, similar components and/or features may have the same numerical reference label. Further, various components of the same type may be distinguished by following the reference label with a letter or by following the reference label with a dash followed by a second numerical reference label that distinguishes among the similar components and/or features. If only the first numerical reference label is used in the specification, the description is applicable to any one of the similar components and/or features having the same first numerical reference label irrespective of the suffix.

DETAILED DESCRIPTION

Embodiments of the present disclosure are related to systems and methods for efficient energy use within a building and comfort of occupants. Some embodiments may use a traditional Building Management System (BMS), Smart Home system, or Smart Office, Smart Building system. Some embodiments include an energy virtualization system linked to one or more smart vents. The energy virtualization system may manage usage and consumption of various energy producers and consumers based on inputs from various controllers. In some instances, the energy virtualization system controls a smart vent (also referred to herein as an "airway manipulation device") in response to a signal generated by a local control. The signal generated by the local control may indicate that a user desires to increase or decrease the temperature in a certain location, e.g., a room, an office, a hallway, etc. A virtual layer of the energy virtualization system may receive the signal generated by the local control, and may, in response, generate a control signal that is sent to the airway manipulation device situated within or near the certain location.

Figure 1:
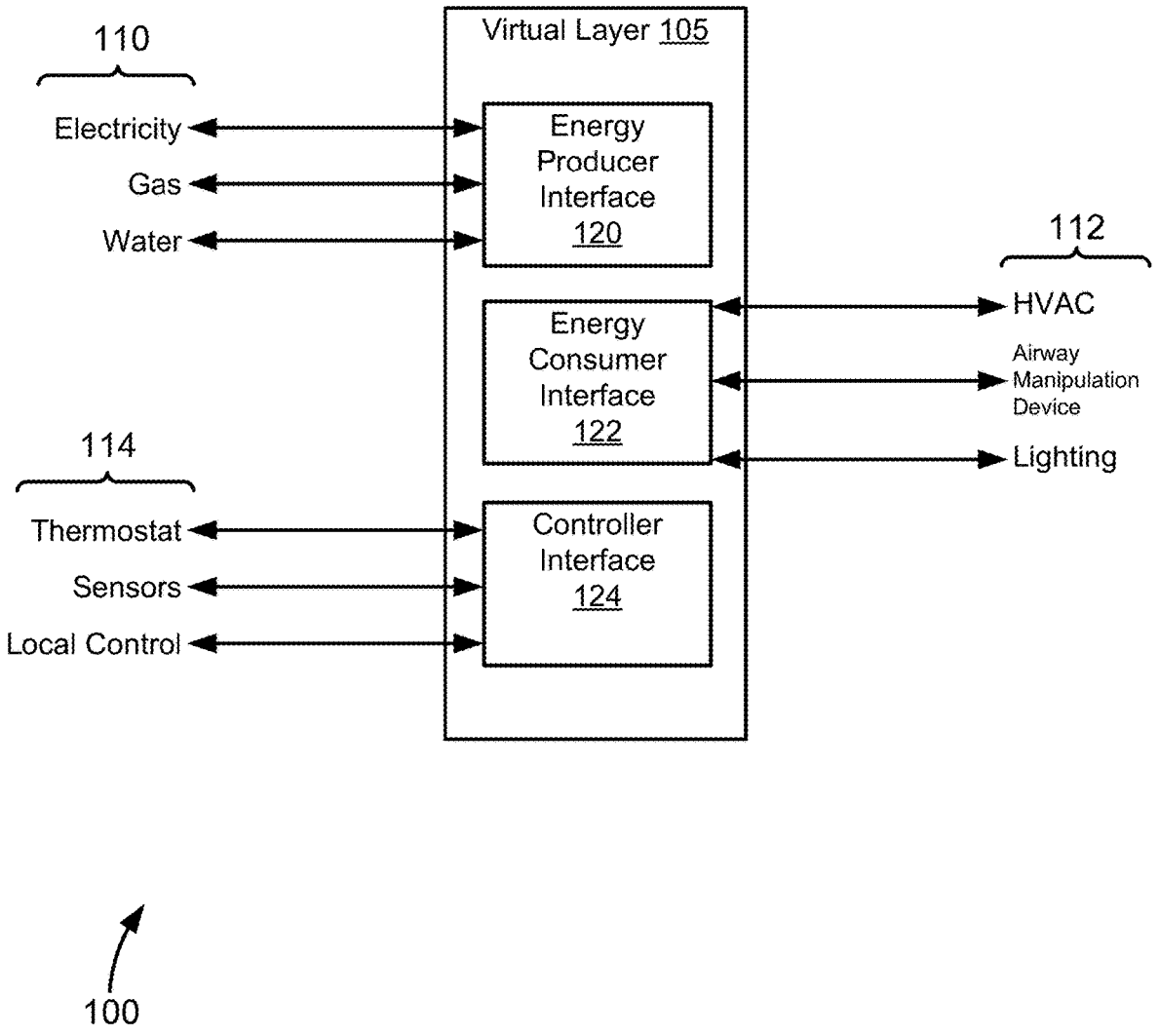
FIG. 1 illustrates an energy virtualization system, according to some embodiments.

FIG. 1 illustrates an energy virtualization system 100, according to some embodiments. In some embodiments, energy virtualization system 100 includes a virtual layer 105 for managing one or more energy producers 110, one or more energy consumers 112, and one or more devices 114. Virtual layer 105 may include various interfaces, such as an energy producer interface 120 for communicating with energy producers 110, an energy consumer interface 122 for communicating with energy consumers 112, and a controller interface 124 for communicating with devices 114. Virtual layer 105 may be implemented in hardware and/or software (e.g., computer code), among other possibilities. Virtual layer 105 may perform various calculations and/or algorithms for generating control signals which may be sent to energy consumers 112. The control signals may be generated based on signals received from energy producers 110 and/or devices 114.

Figure 2:
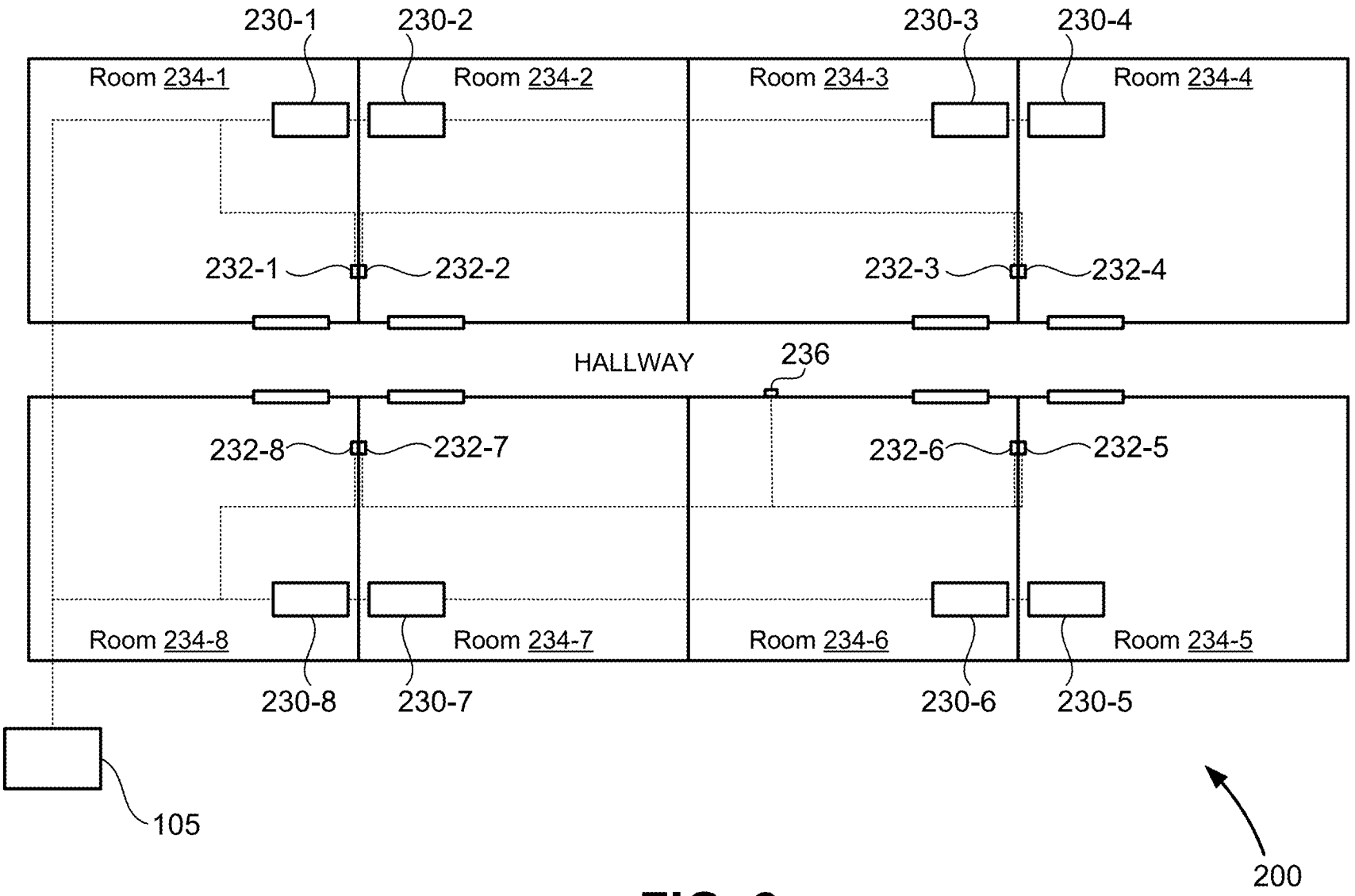
FIG. 2 illustrates an environment incorporating an energy virtualization system, according to some embodiments.

FIG. 2 illustrates an environment 200 incorporating energy virtualization system 100, according to some embodiments. Energy virtualization system 100 may include virtual layer 105 communicatively linked to a plurality of local controls 232 and a plurality of airway manipulation devices 230 situated in different rooms 230 within environment 200. For example, local control 232-1 and airway manipulation device 230-1 may be situated within or near room 234-1, and may be communicatively linked, either via a wired or wireless connection, to virtual layer 105. In some embodiments, each of local controls 232 may comprise an adjustable temperature controller (e.g., a thermostat) that allows an occupant of a particular room to specify a desired temperature (e.g., 70 degrees Fahrenheit). In some embodiments, instead of each of local controls 232 allowing an occupant to specify a numerical value, an occupant may be allowed to specify whether he/she desires an increase or decrease in temperature.

In some embodiments, energy virtualization system 100 may include a central control 236 situated within environment 200 that comprises an adjustable temperature controller (e.g., a thermostat) that allows a user to specify a desired temperature for an area or region within environment 200. For example, central control 236 may be situated within a hallway of environment 200 and may allow a user to specify a temperature for each of rooms 234 or some combination of rooms 234 (e.g., rooms 234-1, 234-2, and 234-3, or rooms on a single side of the hallway). Although the embodiment of FIG. 2 illustrates the airflow manipulation device used in conjunction with a virtualize energy system, other embodiments are not so limited. Specifically, some embodiments of the airflow manipulation device can be integrated with a traditional Building Management System (BMS) or any other system for managing and manipulating the environment of an enclosure. Furthermore, the "local control" may include many different devices, such as mobile devices, personal devices, smart phones, tablet computers, Internet of Things (IoT) devices, and so forth. The terms "airflow manipulation device" and "smart vent" may be used interchangeably herein.

The goal of the airflow manipulation device with both local and central control is to provide more granular control of HVAC systems and temperatures within a targeted area. This corresponds to a higher resolution in temperature control from a spatial perspective. Prior to this disclosure, large air-handling systems controlled the supply of air on a floor in a building as part of a large central HVAC system. They provided conditioned air at a particular volume and flow rate (CFM) to a number of Variable Air Volume (VAV) devices. A number of offices or areas of the building may be served from a single VAV, and thus the air at the VAV does not represent the temperature required in a particular office based on occupant commands or environmental factors, such as sun exposure or building envelope construction.

The airflow manipulation device described herein solves these and other technology problems by reducing the quantity of VAVs required, or even eliminating them in some circumstances. These also reduce the size of the infrastructure required in ceilings, as large VAVs can be replaced by small, in-line airflow manipulation devices. In one embodiment, an in-line mechanism that incorporates an air damper, sensors, a heating element, a control interface, power circuitry, and so forth may be inserted into the air flow duct as an airflow manipulation device. For example, one airflow manipulation device can be easily integrated into the round, flexible ducting that is used to feed the HVAC registers as commonly found in commercial buildings. Because these are installed internally, the airflow manipulation devices negate the need to have aesthetic components as part of the HVAC system. By adjusting the air in line, it also minimizes the perceived noise of constricted air (e.g., whistling) and provides an opportunity to place silencers for such purposes in the ducting itself.

Typical HVAC systems are balanced by manually opening/closing dampers as part of the building commissioning process during construction to regulate the flow of air entering a room or space based on the volume of the space being served. In contrast, the airflow manipulation devices described herein can be integrated with sensors, such as static pressure, volume flow sensors, temperature sensors, and so forth. The airflow manipulation device can provide feedback based on the micro zone (e.g., the individual office) served by the airflow manipulation device. The airflow manipulation device can communicate with the VAV and/or air handler to reduce the airflow for the zone or reduce the fan speed respectively. This ensures the desired temperature is achieved in the target office without impacting neighboring zones or wasting energy.

Some embodiments of the airflow manipulation device may include an in-line heating element that can be used to micro-control the air flowing from the VAV into the office. For example, the supply air from the VAV may be delivered at a lowest-common temperature across a range of offices in a zone, and the electric heating element can serve to increase the temperature air supply in each particular office, based on sensor inputs within that office. Similarly, configurations can use chilled beams, AC coils, and/or other mechanical air conditioning systems locally at the airflow manipulation device to reduce the temperature for a single office.

To power the airflow manipulation device, Power over Ethernet (PoE) may be used to power the actuation of the smart vent itself, power the heating element, and support communications of the sensor data and control inputs. Using PoE can simplify wiring requirements and allow controllers and smart vents to be daisy-chained from duct to duct, and thus minimize the number of power supply ports required for installation. The airflow manipulation device may also provide a resource profile for a virtualized energy layer, or may simply provide a standard BMS interface.

Figure 3:
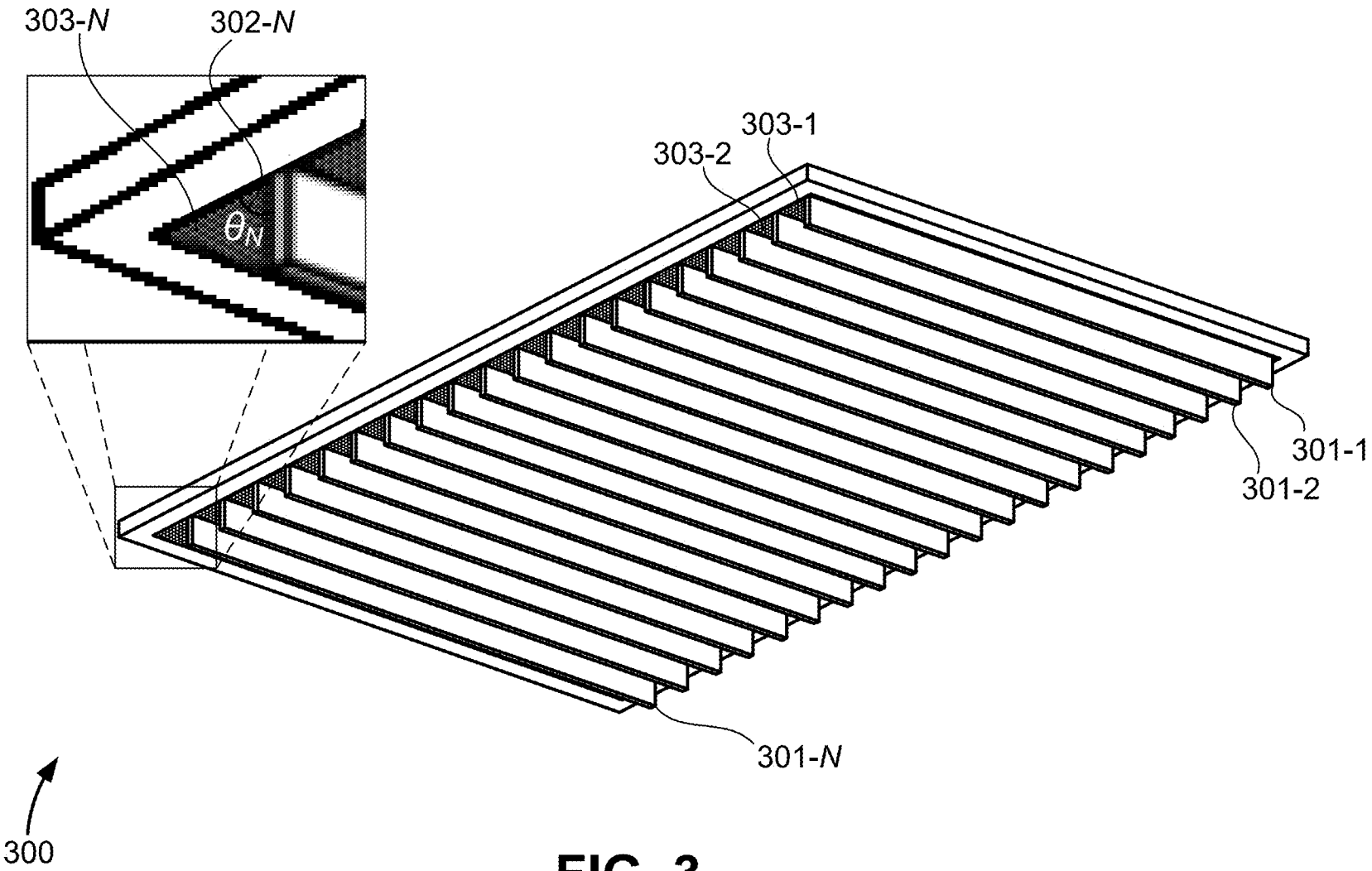
FIG. 3 illustrates a first airflow manipulation device, according to some embodiments.

FIG. 3 illustrates an airflow manipulation device 300, according to some embodiments. Airflow manipulation device 300 may correspond to any of airway manipulation devices 230, and may be positioned along a wall, floor, and/or ceiling of any of rooms 234. Airflow manipulation device 300 may include a plurality of modifiable apertures 303 which are formed by the positioning of a plurality of panels 301 positioned in parallel with each other. Each of panels 301 may be positioned to form an angle 302 with respect to the chassis of airflow manipulation device 300. Airflow manipulation device 300 may receive a control signal from virtual layer 105 and may modify apertures 303 via movement of panels 301.

In some instances, each of panels 301 are moved and positioned in unison such that each of angles 302 remain identical to each other. In other embodiments, different portions of panels 301 may be moved and positioned differently such that different angles 302 may be unique. For example, in some embodiments, panels 301 may be positioned such that half of angles 302 are set to 90 degrees and the other half of angles 302 are set to 0 degrees. In other embodiments, a third of angles 302 may be set to 90 degrees, a third of angles 302 may be set to 45 degrees, and a third of angles 302 may be set to 0 degrees.

Figure 4:
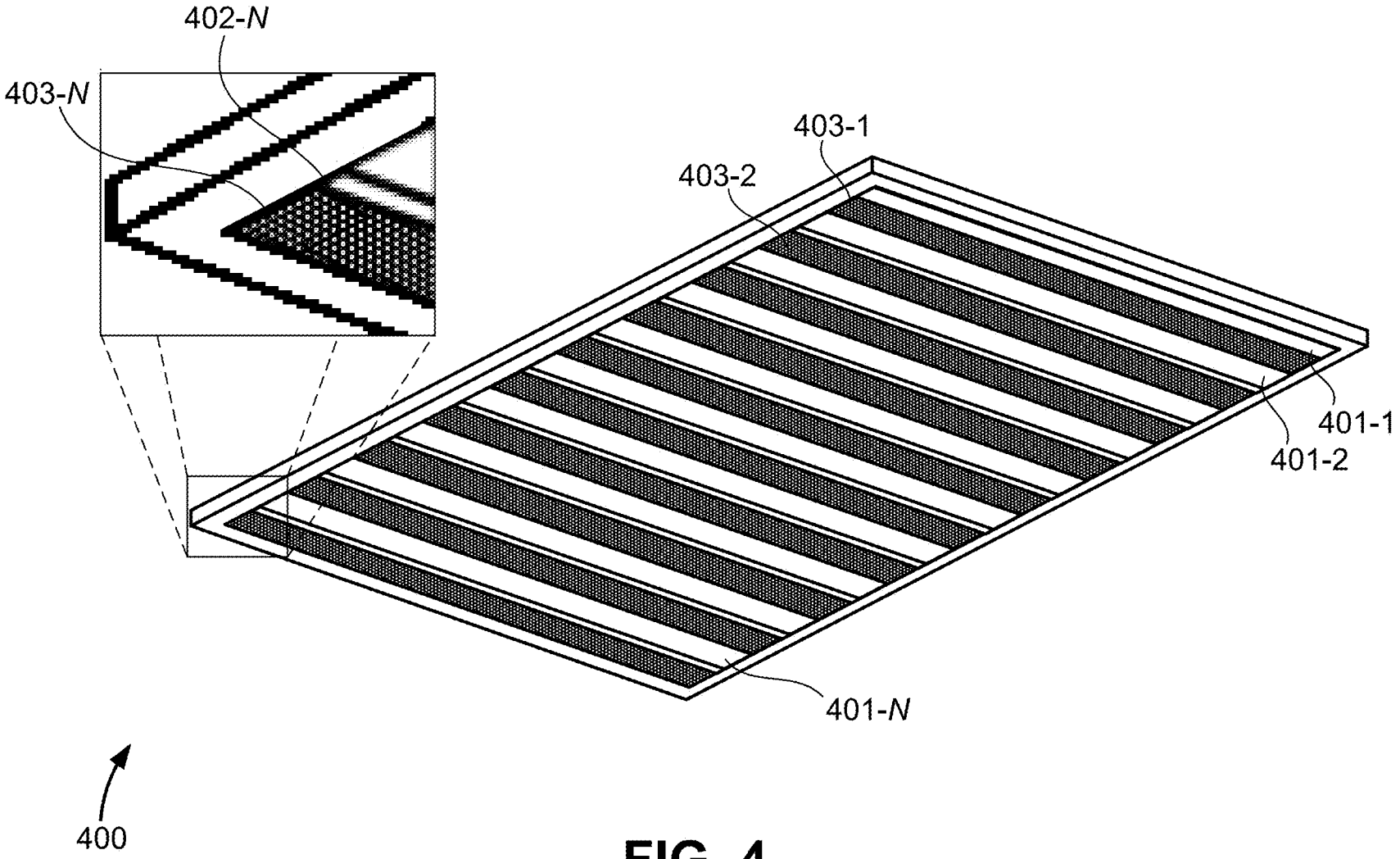
FIG. 4 illustrates a second airflow manipulation device, according to some embodiments.

FIG. 4 illustrates an airflow manipulation device 400, according to some embodiments. Airflow manipulation device 400 may correspond to any of airway manipulation devices 230, and may be positioned along a wall, floor, and/or ceiling of any of rooms 234. Airflow manipulation device 400 may include a plurality of modifiable apertures 403 which are formed by the positioning of a plurality of sliding panels 401 positioned in parallel with each other. Each of panels 401 may be positioned to form an openness ratio 402. Airflow manipulation device 400 may receive a control signal and may modify apertures 403 via movement (e.g., sliding) of panels 401.

In some instances, each of panels 401 are moved and positioned in unison such that each of openness ratios 402 remain identical to each other. In other embodiments, different portions of panels 401 may be moved and positioned differently such that different openness ratios 402 may be different. For example, in some embodiments, panels 401 may be positioned such that half of openness ratios 402 are set to 100% and the other half of openness ratios 402 are set to 0%. In other embodiments, a third of openness ratios 402 may be set to 100%, a third of openness ratios 402 may be set to 50%, and a third of openness ratios 402 may be set to 0%.

Figure 5:
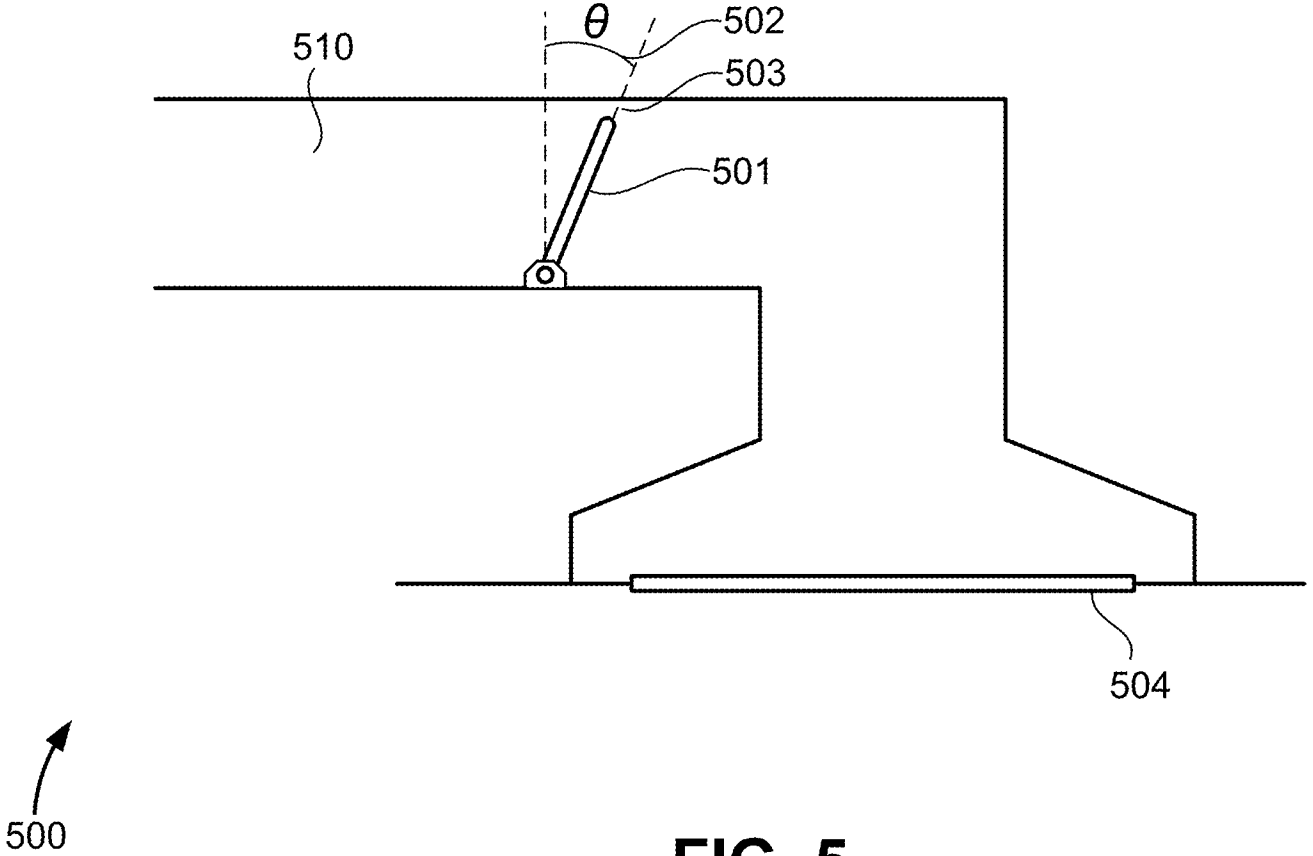
FIG. 5 illustrates a third airflow manipulation device, according to some embodiments.

FIG. 5 illustrates an airflow manipulation device 500, according to some embodiments. Airflow manipulation device 500 may correspond to any of airway manipulation devices 230, and may be positioned along a wall, floor, and/or ceiling of any of rooms 234. Airflow manipulation device 500 may include a modifiable aperture 503 which is formed by the positioning of a rotatable panel 501 situated within an airway 510. Panel 501 may be positioned to form angle 502 with respect to a direction perpendicular to airway 510. Optionally, airflow manipulation device 500 may include a vent 504 which may separate airway 510 from the rest of room 234. In some embodiments, airflow manipulation device 500 receives a control signal from virtual layer 105 and may modify aperture 503 via movement of panel 501.

Figure 6:
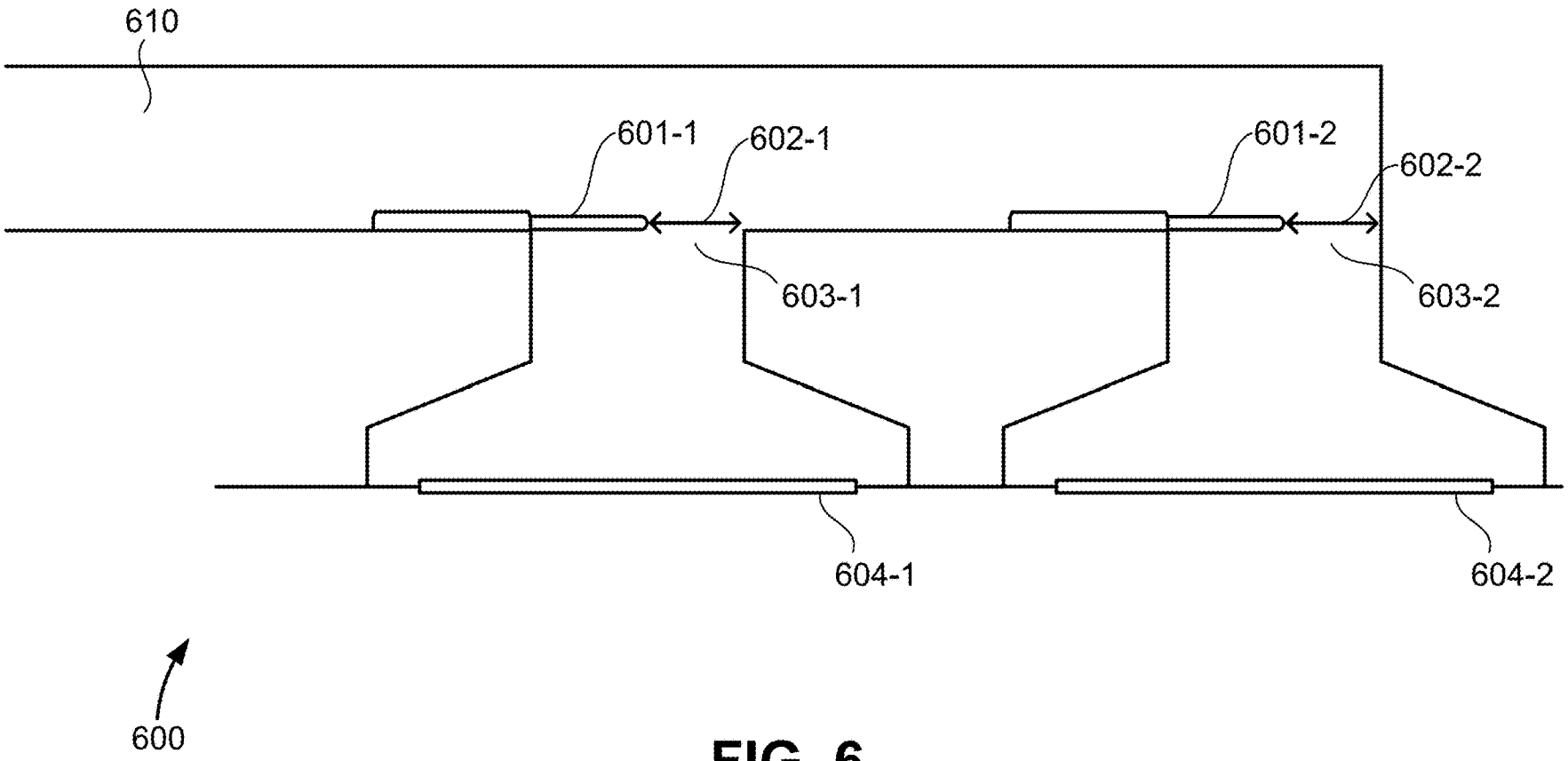
FIG. 6 illustrates multiple airflow manipulation devices situated in series with each other, according to some embodiments.

FIG. 6 illustrates two airflow manipulation devices 600 situated in series with each other, according to some embodiments. Airflow manipulation devices 600 may correspond to any of airway manipulation devices 230, and may be positioned along a wall, floor, and/or ceiling of any of rooms 234. Each of airflow manipulation devices 600 may include a modifiable aperture 603 which is formed by the positioning of a sliding panel 601 situated within an airway 610. Optionally, each of airflow manipulation devices 600 may include a vent 604 which may separate airway 610 from the rest of rooms 234. Each of panels 601 may be positioned to form an openness ratio 602. Each of airflow manipulation devices 600 may receive a control signal from virtual layer 105 and may modify apertures 603 via movement (e.g., sliding) of panels 601.

In some embodiments, virtual layer 105 is configured to generate and output a control signal to each the airway manipulation device described herein, such as airway manipulation devices 300, 400, 500, and/or 600. The control signal may including instructions to modify an aperture, either directly or indirectly, by specifying a specific numerical aperture state (e.g., 100% open, 45 degrees open, etc.), or by specifying a percentage of increased or decreased change (e.g., 10% more open, 20% more closed, etc.). The control signal may be generated based on at least a first input signal received from the local control and a second input signal received from the central control. For example, where the first input signal received from the local control differs and the second input signal, an average of the two signals (e.g., an average temperature) may be used as a target temperature when generating the control signal. Other possibilities are anticipated. In some embodiments, the control signal may be generated exclusively based on the first signal received from the local control to override any second input signal received from the central control. For example, a user may operate their local control to regulate the airflow of the smart vents in their office without changing the temperature of the air that is being delivered to the smart vent from the central HVAC system. This allows users to maintain local control over the temperature in their rooms to some degree without requiring a change in air temperature or air delivery volume from the central HVAC system.

In some embodiments, the smart vents in a region of the building can receive coordinated controls from the central control. For example, when the sun begins to set later in the day, one side of the building may be exposed to more sunlight energy than the other side of the building. If both sides of the building are supplied by the same HVAC system, lowering the temperature on the side of the building exposed to the sunlight may result in temperatures that are too cold for the other side of the building. Using the smart vents described herein, a series of control signals can be coordinated from the central control to reduce the cool airflow in rooms on the side of the building that are not exposed to the sun, while simultaneously increasing the airflow in rooms on the side of the building that are exposed to the sun.

In some embodiments, the central control can monitor the local control inputs received in each room having a smart vent. The central control can aggregate these local control inputs and determine whether changes need to be made to the operation of the HVAC system in a corresponding region of the building. For example, if all of the rooms on a specific floor of the building submit local control inputs during a time window, the central control can determine that the overall air temperature delivered by the HVAC system to that specific floor should be changed to correspond to the local control inputs provided by the users. Thus, when enough local control inputs indicate that a central control input may be required in the region, the central control can respond accordingly. Instead of throttling or increasing the airflow in individual rooms, the central control can respond by increasing/decreasing the airflow/temperature to that region and set the smart vents therein back to a normal setting.

Figure 7:
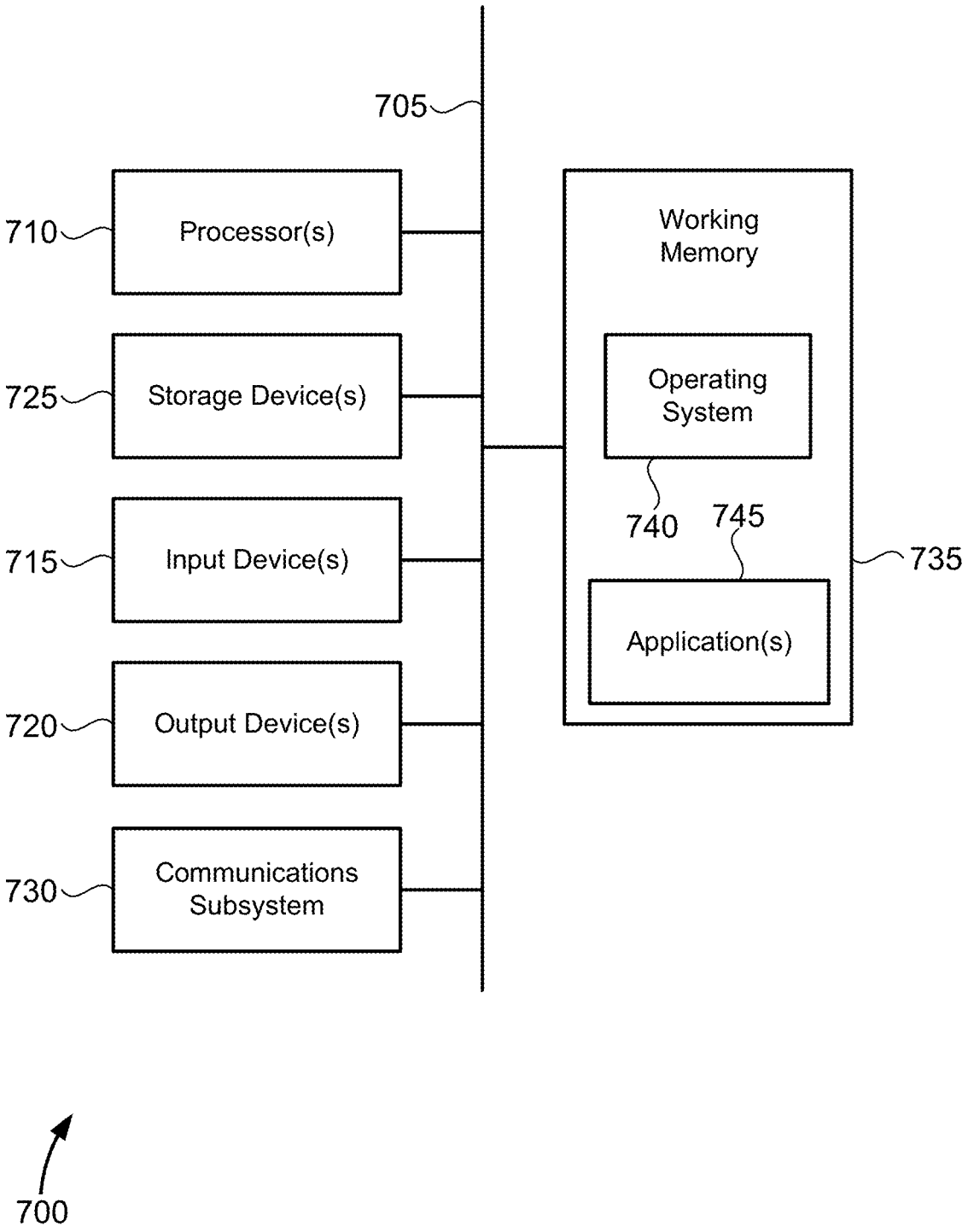
FIG. 7 illustrates a simplified computer system, according to some embodiments.

FIG. 7 illustrates a simplified computer system 700, according to some embodiments. A computer system 700 as illustrated in FIG. 7 may be incorporated into devices such as a portable electronic device, mobile phone, or other device as described herein. FIG. 7 provides a schematic illustration of one embodiment of a computer system 700 that can perform some or all of the steps of the methods provided by various embodiments. It should be noted that FIG. 7 is meant only to provide a generalized illustration of various components, any or all of which may be utilized as appropriate. FIG. 7, therefore, broadly illustrates how individual system elements may be implemented in a relatively separated or relatively more integrated manner.

The computer system 700 is shown comprising hardware elements that can be electrically coupled via a bus 705, or may otherwise be in communication, as appropriate. The hardware elements may include one or more processors 710, including without limitation one or more general-purpose processors and/or one or more special-purpose processors such as digital signal processing chips, graphics acceleration processors, and/or the like; one or more input devices 715, which can include without limitation a mouse, a keyboard, a camera, and/or the like; and one or more output devices 720, which can include without limitation a display device, a printer, and/or the like.

The computer system 700 may further include and/or be in communication with one or more non-transitory storage devices 725, which can comprise, without limitation, local and/or network accessible storage, and/or can include, without limitation, a disk drive, a drive array, an optical storage device, a solid-state storage device, such as a random access memory ("RAM"), and/or a read-only memory ("ROM"), which can be programmable, flash-updateable, and/or the like. Such storage devices may be configured to implement any appropriate data stores, including without limitation, various file systems, database structures, and/or the like.

The computer system 700 might also include a communications subsystem 730, which can include without limitation a modem, a network card (wireless or wired), an infrared communication device, a wireless communication device, and/or a chipset such as a Bluetooth™ device, an 802.11 device, a WiFi device, a WiMax device, cellular communication facilities, etc., and/or the like. The communications subsystem 730 may include one or more input and/or output communication interfaces to permit data to be exchanged with a network such as the network described below to name one example, other computer systems, television, and/or any other devices described herein. Depending on the desired functionality and/or other implementation concerns, a portable electronic device or similar device may communicate image and/or other information via the communications subsystem 730. In other embodiments, a portable electronic device, e.g. the first electronic device, may be incorporated into the computer system 700, e.g., an electronic device as an input device 715. In some embodiments, the computer system 700 will further comprise a working memory 735, which can include a RAM or ROM device, as described above.

The computer system 700 also can include software elements, shown as being currently located within the working memory 735, including an operating system 740, device drivers, executable libraries, and/or other code, such as one or more application programs 745, which may comprise computer programs provided by various embodiments, and/or may be designed to implement methods, and/or configure systems, provided by other embodiments, as described herein. Merely by way of example, one or more procedures described with respect to the methods discussed above, such as those described in relation to FIG. 7, might be implemented as code and/or instructions executable by a computer and/or a processor within a computer; in an aspect, then, such code and/or instructions can be used to configure and/or adapt a general purpose computer or other device to perform one or more operations in accordance with the described methods.

A set of these instructions and/or code may be stored on a non-transitory computer-readable storage medium, such as the storage device(s) 725 described above. In some cases, the storage medium might be incorporated within a computer system, such as computer system 700. In other embodiments, the storage medium might be separate from a computer system e.g., a removable medium, such as a compact disc, and/or provided in an installation package, such that the storage medium can be used to program, configure, and/or adapt a general purpose computer with the instructions/code stored thereon. These instructions might take the form of executable code, which is executable by the computer system 700 and/or might take the form of source and/or installable code, which, upon compilation and/or installation on the computer system 700 e.g., using any of a variety of generally available compilers, installation programs, compression/decompression utilities, etc., then takes the form of executable code.

It will be apparent to those skilled in the art that substantial variations may be made in accordance with specific requirements. For example, customized hardware might also be used, and/or particular elements might be implemented in hardware, software including portable software, such as applets, etc., or both. Further, connection to other computing devices such as network input/output devices may be employed.

As mentioned above, in one aspect, some embodiments may employ a computer system such as the computer system 700 to perform methods in accordance with various embodiments of the technology. According to a set of embodiments, some or all of the procedures of such methods are performed by the computer system 700 in response to processor 710 executing one or more sequences of one or more instructions, which might be incorporated into the operating system 740 and/or other code, such as an application program 745, contained in the working memory 735. Such instructions may be read into the working memory 735 from another computer-readable medium, such as one or more of the storage device(s) 725. Merely by way of example, execution of the sequences of instructions contained in the working memory 735 might cause the processor(s) 710 to perform one or more procedures of the methods described herein. Additionally or alternatively, portions of the methods described herein may be executed through specialized hardware.

The terms "machine-readable medium" and "computer-readable medium," as used herein, refer to any medium that participates in providing data that causes a machine to operate in a specific fashion. In an embodiment implemented using the computer system 700, various computer-readable media might be involved in providing instructions/code to processor(s) 710 for execution and/or might be used to store and/or carry such instructions/code. In many implementations, a computer-readable medium is a physical and/or tangible storage medium. Such a medium may take the form of a non-volatile media or volatile media. Non-volatile media include, for example, optical and/or magnetic disks, such as the storage device(s) 725. Volatile media include, without limitation, dynamic memory, such as the working memory 735.

Common forms of physical and/or tangible computer-readable media include, for example, a floppy disk, a flexible disk, hard disk, magnetic tape, or any other magnetic medium, a CD-ROM, any other optical medium, punch-cards, papertape, any other physical medium with patterns of holes, a RAM, a PROM, EPROM, a FLASH-EPROM, any other memory chip or cartridge, or any other medium from which a computer can read instructions and/or code.

Various forms of computer-readable media may be involved in carrying one or more sequences of one or more instructions to the processor(s) 710 for execution. Merely by way of example, the instructions may initially be carried on a magnetic disk and/or optical disc of a remote computer. A remote computer might load the instructions into its dynamic memory and send the instructions as signals over a transmission medium to be received and/or executed by the computer system 700.

The communications subsystem 730 and/or components thereof generally will receive signals, and the bus 705 then might carry the signals and/or the data, instructions, etc. carried by the signals to the working memory 735, from which the processor(s) 710 retrieves and executes the instructions. The instructions received by the working memory 735 may optionally be stored on a non-transitory storage device 725 either before or after execution by the processor(s) 710.

Figure 8:
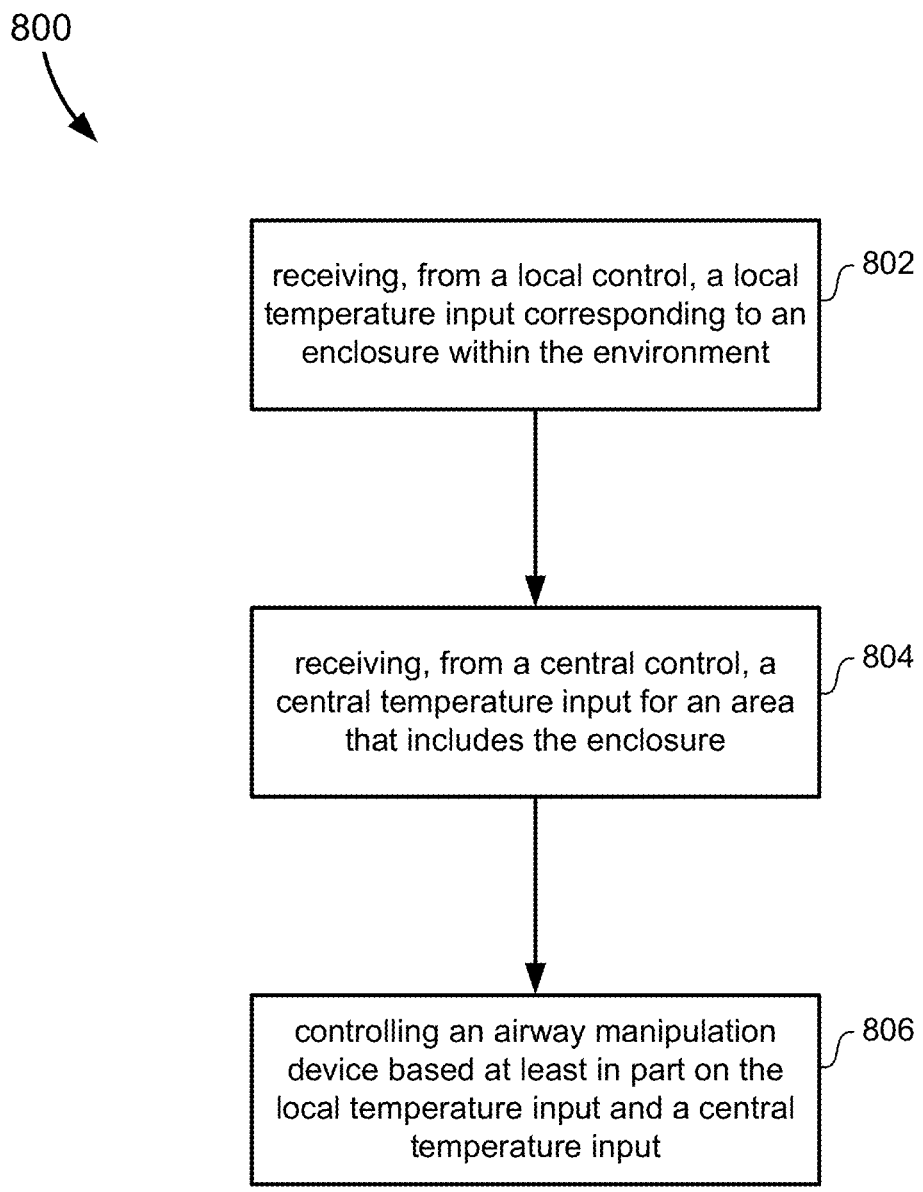
FIG. 8 illustrates a flowchart of a method for controlling an energy system, according to some embodiments.

FIG. 8 illustrates a flowchart of a method for controlling an energy system, according to some embodiments. The method may include receiving a local temperature input from a local control that corresponds to an enclosure within the environment (802). The local control may be a local thermostat in a room, the environment may be a building or home, and the enclosure may be an office or room within the environment. The local control can be transmitted via a wired or wireless connection to a central control. The method may also include receiving a central temperature input from a central control for an area that includes the enclosure (804). The central temperature input may be a temperature setpoint that contributes to governing the control of multiple airway manipulation devices within the enclosure. The area that includes the enclosure may include a floor in a home, a floor in an office building, or a collection of offices that are within a threshold distance of each other, such as 50 feet, 75 feet, and so forth. The method may further include controlling an airway manipulation device based at least in part on the local temperature input and the central temperature input (806). The airway manipulation device may be situated within or within a threshold distance of the enclosure. The threshold distance may include 2 feet, 5 feet, 10 feet, or 20 feet. For example, the airway manipulation device may include a smart vent that is located above a room. The airway manipulation device may be configured to modify at least one aperture separating two volumes. The two volumes may include a volume of an air duct that is separated from a volume of the enclosure. The airway manipulation device may be powered using an ethernet connection and may communicate with the one or more processors using an ethernet connection. The airway manipulation device may be controlled through a virtualization layer that is executed by the one or more processors as described above. In some embodiments, the local temperature input can override the central temperature input, while in other embodiments the local temperature input can be averaged with the central temperature input.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of exemplary configurations including implementations. However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a schematic flowchart or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the technology. Also, a number of steps may be undertaken before, during, or after the above elements are considered. Accordingly, the above description does not bind the scope of the claims.

As used herein and in the appended claims, the singular forms "a", "an", and "the" include plural references unless the context clearly dictates otherwise. Thus, for example, reference to "a user" includes a plurality of such users, and reference to "the processor" includes reference to one or more processors and equivalents thereof known to those skilled in the art, and so forth.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. An energy system incorporated within an environment, the energy system comprising:

a local control for receiving a local temperature input corresponding to an enclosure within the environment;

an airway manipulation device situated within or within a threshold distance of the enclosure, the airway manipulation device configured to modify at least one aperture separating two volumes;

a central control for receiving a central temperature input for an area that includes the enclosure; and one or more processors programmed to:

receive a signal from the local control representing the local temperature input;

receive a signal from the central control representing the central temperature input; and generate a control signal to control the airway manipulation device based at least in part on a combination of the local temperature input represented by the signal from the local control and the central temperature input represented by the signal from the central control.

2. The energy system of claim 1, wherein the airway manipulation device communicates with the one or more processors using an ethernet connection.

3. The energy system of claim 2, wherein the airway manipulation device receives power to modify the at least one aperture through the ethernet connection.

4. The energy system of claim 1, further comprising a plurality of local controls that includes the local control, wherein the plurality of local controls are located in other enclosures that are within a threshold distance of the enclosure.

5. The energy system of claim 4, wherein the one or more processors are further programmed to send a coordinated control signal to a plurality of airway manipulation devices corresponding to the plurality of local controls, wherein the coordinated control signal compensates for sunlight exposure.

6. The energy system of claim 4, wherein the one or more processors are further programmed to receive a plurality of local temperature inputs from the local controls and adjust the central temperature input for the area based on the plurality of local temperature inputs.

7. The energy system of claim 1, wherein the one or more processors are further programmed to operate an energy virtualization layer that receives commands from a plurality of energy control devices and controls the flow of energy between a plurality of energy producing devices and a plurality of energy consuming devices.

8. The energy system of claim 1, wherein controlling the airway manipulation device comprises moving a plurality of panels to modify the at least one aperture.

9. The energy system of claim 1, wherein the local temperature input is averaged with the central temperature input.

10. The energy system of claim 1, wherein the local temperature input overrides the central temperature input.

11. A method for controlling an energy system incorporated within an environment, the method comprising:

receiving, from a local control for receiving local temperature inputs corresponding to an enclosure within the environment, a signal representing a local temperature input corresponding to the enclosure within the environment;

receiving, from a central control for receiving central temperature inputs for an area that includes the enclosure, a signal representing a central temperature input for the area that includes the enclosure; and generating a control signal to control an airway manipulation device based at least in part on a combination of the local temperature input represented by the signal from the local control and the central temperature input represented by the signal from the central control, wherein:

the airway manipulation device is situated within or within a threshold distance of the enclosure; and the airway manipulation device is configured to modify at least one aperture separating two volumes.

12. The method of claim 11, wherein the airway manipulation device communicates with the one or more processors using an ethernet connection.

13. The method of claim 12, wherein the airway manipulation device receives power to modify the at least one aperture through the ethernet connection.

14. The method of claim 11, wherein the energy system further comprises a plurality of local controls that includes the local control, wherein the plurality of local controls are located in other enclosures that are within a threshold distance of the enclosure.

15. The method of claim 14, further comprising sending a coordinated control signal to a plurality of airway manipulation devices corresponding to the plurality of local controls, wherein the coordinated control signal compensates for sunlight exposure.

16. The method of claim 14, further comprising receiving a plurality of local temperature inputs from the local controls and adjust the central temperature input for the area based on the plurality of local temperature inputs.

17. The method of claim 11, further comprising operating an energy virtualization layer that receives commands from a plurality of energy control devices and controls the flow of energy between a plurality of energy producing devices and a plurality of energy consuming devices.

18. The method of claim 11, wherein controlling the airway manipulation device comprises moving a plurality of panels to modify the at least one aperture.

19. The method of claim 11, wherein the local temperature input is averaged with the central temperature input.

20. The method of claim 11, wherein the local temperature input overrides the central temperature input.

* * * * *